United States Patent [19]

Noack

[11] 4,411,868

[45] Oct. 25, 1983

[54] MULTIPLE TUBE RACK

[75] Inventor: W. L. Noack, Camarillo, Calif.

[73] Assignee: Becton, Dickinson and Company, Paramus, N.J.

[21] Appl. No.: 329,779

[22] Filed: Dec. 11, 1981

[51] Int. Cl.[3] ..... B01L 9/06

[52] U.S. Cl. ..... 422/104; 211/74; 211/60 R; 211/71; 220/21; 435/809; 422/102

[58] Field of Search ..... 422/102, 104; 435/809, 435/301, 300, 293; 73/864.19; 220/21, 23.8; 211/74, 60 R, 71; 206/19; D6/125; D24/32

[56] References Cited

U.S. PATENT DOCUMENTS

| | | | |
|---|---|---|---|
| 697,247 | 4/1902 | Harris | 206/19 |
| 2,936,163 | 5/1960 | Foster | 211/74 |
| 3,186,556 | 6/1965 | Forsstrom | 211/74 |
| 3,379,315 | 4/1968 | Broadwin | 211/74 |
| 3,456,806 | 7/1969 | Borston | 211/60 |
| 3,713,985 | 1/1973 | Astle | 435/301 |
| 4,124,122 | 11/1978 | Emmitt | 422/104 |
| 4,278,176 | 7/1981 | Adams | 211/74 |
| 4,281,768 | 8/1981 | Sommers | 211/74 |

OTHER PUBLICATIONS

Modern Lab. Appliances, Fisher Sci. Co. Cat. #63, pp. 912–914.

Sargent-Welch Sci. Co. Cat. No. 119, pp. 1022–1023.

*Primary Examiner*—Michael S. Marcus

*Attorney, Agent, or Firm*—Ricahrd J. Rodrick

[57] ABSTRACT

A rack for holding a plurality of tubes comprises a support member having a raised center portion. The support member includes a plurality of holes therein distributed throughout. These holes, for receiving tubes therein, are arranged in staggered fashion along the transverse axis of the support member.

5 Claims, 5 Drawing Figures

FIG. 5
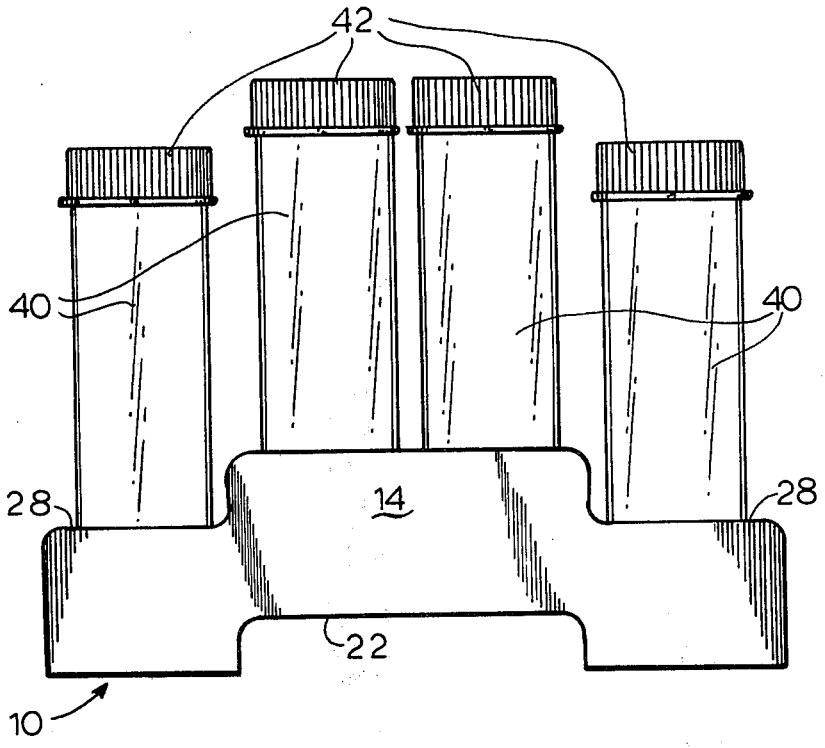
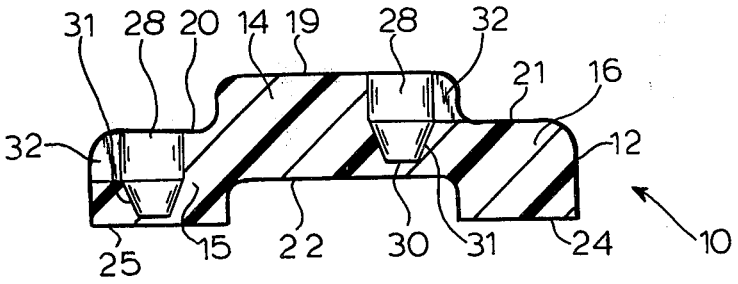
FIG. 3

MULTIPLE TUBE RACK

BACKGROUND OF THE INVENTION

1. Field of the Invention

The present invention relates to a rack for holding a plurality of tubes, and more particularly, concerns an improvement in a multiple tube rack for holding test tubes and the like during laboratory or clinical procedures.

2. Description of the Prior Art

In many procedures in the laboratory, such as assaying and the like, the operator employs many test tubes at one time. Inasmuch as these procedures usually require the delivery of one or more materials into the tubes, it is necessary to assure that the tubes are vertically arranged in an upright position. Frame supports are available for holding rows of such test tubes for laboratory purposes. These frames are commonly made out of metal and suffer from one or more deficiencies.

For instance, many metal frames have two holes for each test tube, a hole through an upper framework and another hole through a lower framework aligned therewith. This type of structure oftentimes hides the contents of the various test tubes being utilized. In addition, many racks for holding a plurality of test tubes are designed to hold them in an orthogonal array. In these cases, each of the test tubes are resting generally at the same level so that it is difficult to lift individual tubes from the frame. Also, in such an orthogonal array, adjacent test tubes are stacked so close to each other that it is difficult for the operator to place his fingers around individual tubes. These types of racks do not facilitate the handling of individual test tubes therein, thereby increasing the possibilities that cross-contamination may occur during the utilization of more than one test tube. Moreover, most racks for holding a plurality of tubes are bench-type versions into which the various test tubes are placed before the experiment to be conducted. It would be desirable for the operator to work with a preassembled multiple tube rack in which the test tubes are already pre-positioned in the rack with the rack being positionable on the laboratory bench for the experimentation at hand. It is to the fulfillment of these desired objectives that the present invention is directed.

SUMMARY OF THE INVENTION

The rack of the present invention holds a plurality of tubes. This rack comprises a support member having a raised center portion and includes a plurality of holes distributed throughout. These holes are arranged in staggered fashion along the transverse axis of the support member.

In a preferred embodiment of the present invention, the support member is substantially planar and is made of thermoformed material. The support member includes a center portion and a side portion along each side of the center portion. An upper surface on the center portion is raised above the upper surfaces of the side portions. The holes in the support member extend partially through the respective center and side portions thereby forming closed bottoms thereof. It is preferred that the holes are tapered toward the bottom surfaces in order to facilitate the insertion of conically shaped tubes therein. All of the holes in the support member are arranged in staggered fashion so that no adjacently lying holes are aligned on an axis substantially perpendicular to the longitudinal axis of the support member.

It is preferred to include a slot adjacent each hole and communicating therewith extending partially into the support member to provide a view into the interior of the holes. This slot will allow the user to have a clear view of the contents of the tubes placed in the rack.

In accordance with the principles of the present invention, a number of significant advantages and features are offered. For instance, both the elevated nature of the center portion of the support member and the staggered hole pattern contribute to easy access of individual tubes by the user. In various embodiment of the present invention, a slot associated with each hole provides the user with a better view of the contents of the tube positioned in that hole. In addition, embodiments of the present invention provide holes having closed bottoms in the support member which contribute to minimizing contamination when using the present invention. In other embodiments of the invention, the elevated nature of the center portion provides easy access of the user's fingers between the bottom of the rack and the lab bench surface for ease of handling. The present invention may have numbering indicia thereon in order to designate tube location within the rack. Furthermore, the preferred material for making the rack is an expandable polystyrene, generally of a high density, debris free material. This polystyrene is lightweight, resists commonly used chemicals in the laboratory and is readily thermoformable into the desired shape and configuration. Thus, it is convenient for one of the embodiments of the present invention to include the test tubes already pre-assembled into the multiple tube rack so that it can be sterilized and shipped to the laboratory as a complete unit, ready to be used for laboratory purposes. In such pre-assembled condition, embodiments of the present invention allow the total assembly to be stacked in nested fashion with similar assemblies assuring stability and savings of space.

BRIEF DESCRIPTION OF THE DRAWINGS

FIG. 3 is a cross-sectional view of the multiple tube rack taken along line 3—3 of FIG. 2;

FIG. 5 is an end view of the multiple tube rack assembly with test tubes.

DETAILED DESCRIPTION

Figure 1:
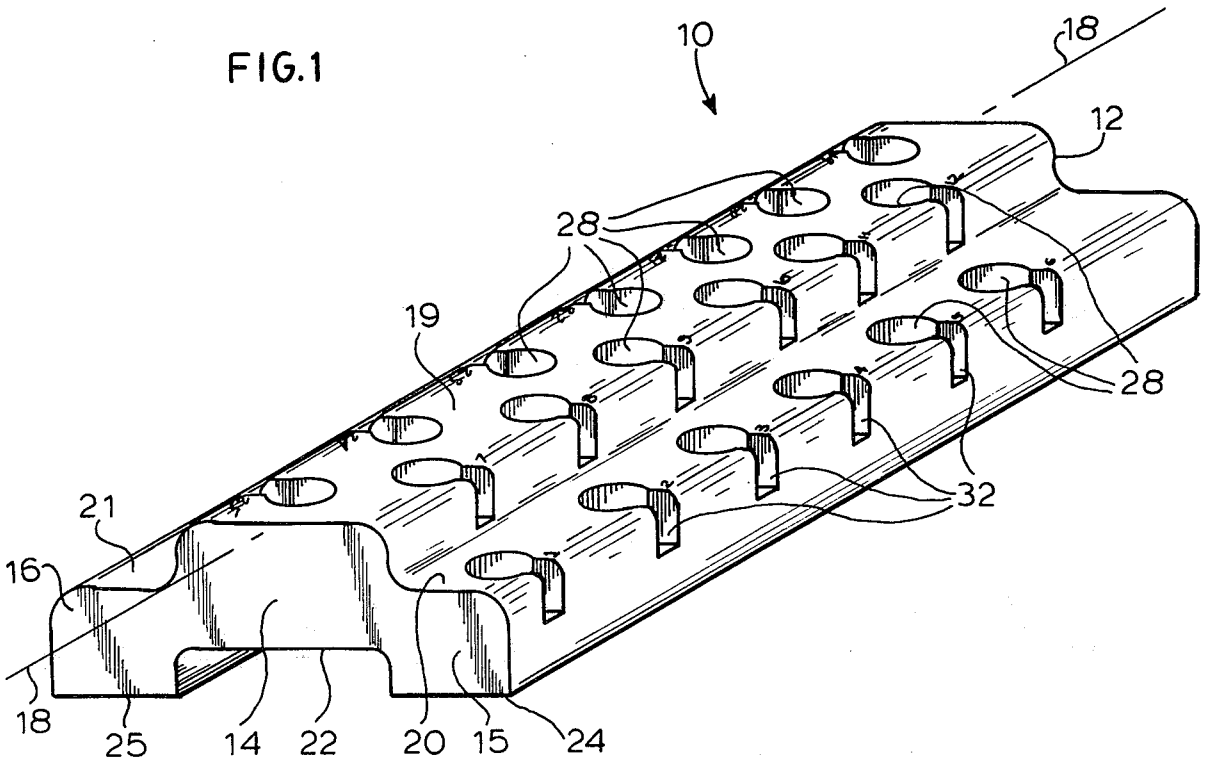
FIG. 1 is a perspective view of the preferred embodiment of the multiple tube rack of the present invention.

While this invention is satisfied by embodiments in many different forms, there is shown in the drawings and will herein be described in detail a preferred embodiment of the invention, with the understanding that the present disclosure is to be considered as exemplary of the principles of the invention and is not intended to limit the invention to the embodiment illustrated. The scope of the invention will be measured by the appended claims and their equivalents.

Figure 2:
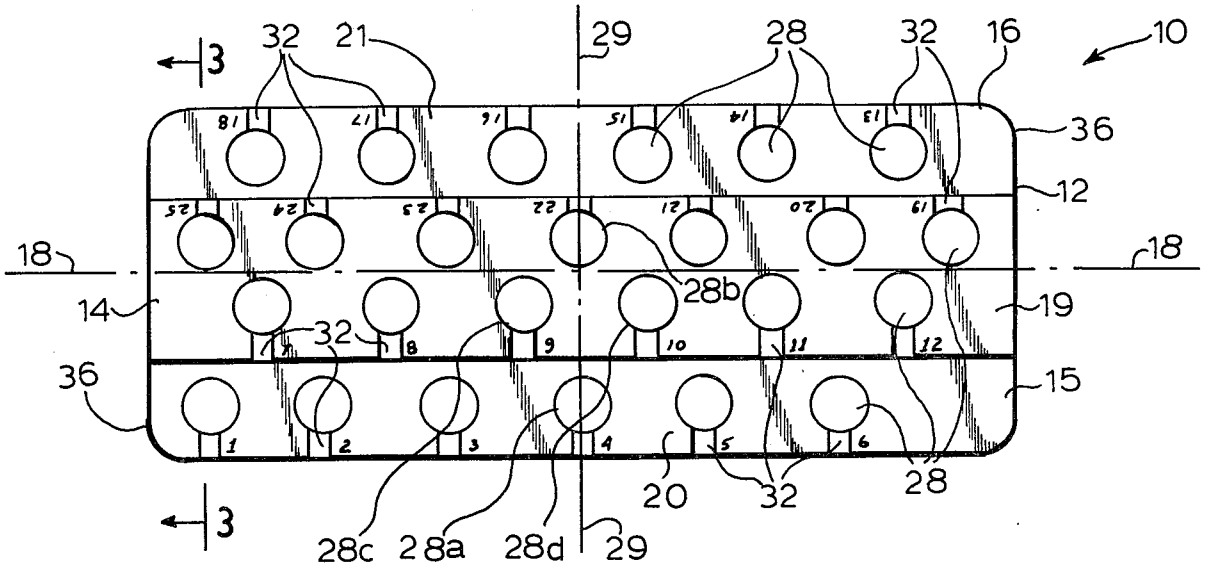
FIG. 2 is a plan view of the multiple tube rack of FIG. 1.

Adverting to the drawings, and FIGS. 1–3 in particular, there is illustrated the preferred multiple tube rack 10 of the present invention. Rack 10 is preferably a one-piece, integral structure serving as a support member 12. It can be seen that support member 12 is essentially a substantially planar, preferably elongated structure. This support member is preferably divided into three sections; a center portion 14, a first side portion 15 and a second side portion 16. All of the above portions of the support member extend substantially parallel to each other along the longitudinal axis 18 of the support member.

Center portion 14 is defined by an upper surface 19 which is raised above upper surfaces 20 and 21 on the respective side portions. In order to contribute to the advantageous features of the present invention, it is also preferred that center portion 14 include a lower surface 22 raised above lower surfaces 24 and 25 on the respective side portions. As mentioned above, raised lower surface 22 provides access for the fingers of the user of the present invention when lifting and handling same. Raised lower surface 22, with respect to lower surfaces 24 and 25, also provides a nesting feature for stacking racks similar to the present invention during shipment and storage. This constributes to storage stability while saving space.

A plurality of holes 28 is distributed substantially uniformly throughout the entire upper surfaces of support member 12. Holes 28 are intended to receive circuitry shaped test tubes therein. It is preferred that all of the holes have a substantially uniform diameter so that the test tubes to be placed therein can be substantially similar, at least with respect to diameter. It is understood that the size of the holes in the support member of the present invention may be varied depending upon choice and the requirements for use of the multiple tube rack. In order to provide improved access to the test tubes to be placed in rack 10, holes 28 are arranged in staggered fashion along a transverse axis 29 of the support member. In the embodiment being described, a transverse axis is meant to include any axis along the longitudinal length of the support member which is substantially perpendicular to longitudinal axis 18 of the support member. Only one such transverse axis 29 is designated in FIG. 2, merely for illustrative purposes. However, by referring particularly to FIGS. 1 and 2, it can be seen that there are no holes 28 lying adjacent to each other along a transverse axis 29. In other words, and for illustrative purposes, holes **28*a* and 28*b* lie along transverse axis 29. However, these two holes are separated by a row of other holes. Thus, the holes which are adjacent hole 28*a* are holes 28*c* and 28*d*. These adjacently lying holes 28*c* and 28*d* are not aligned with holes 28*a* and 28*b* along transverse axis 29. Accordingly, a staggered pattern of holes is provided in support member 12 so that more room is provided for the fingers of the user in gaining access to the test tubes which are placed into the rack area. In the embodiment being described, each of side portions 15 and 16 include a single row of holes therein extending substantially parallel to the longitudinal axis of the support member; center portion 14** has a double, staggered row of holes also extending substantially parallel to the longitudinal axis of the support member. It is noted that the staggered pattern of holes pertains to adjacently lying holes irrespective of the portion in which it is positioned.

In the preferred embodiment of the present invention, holes 28 extend partially through the respective portions in which they lie. In this fashion, each hole terminates in a closed bottom 30, as more clearly illustrated in FIG. 3. By providing this closed bottom in the holes, cross-contamination of the contents of respective test tubes is minimized when the multiple tube rack is being utilized. In the embodiment being described, holes 28 include a tapered surface 31 extending toward bottom surfaces 30. This tapered surface in each hole is particularly desirable when test tubes with conically shaped closed ends are intended to be inserted in the rack of the present invention. This feature contributes to the desired snug fit of the tubes in the rack so that the user is provided with single hand manipulation of the tubes and to allow him to single-handedly remove the caps from the tubes.

In order to achieve some of the desirable features mentioned above, a slot 32 is associated with each hole in the support member. Slots 32 extend partially into the respective center and side portions and communicate with the holes with which they are associated. When employing these slots with the present invention, they provide the user with a better ability to view the contents of all the test tubes which are placed in the holes. Other features which may be included in the multiple tube rack of the present invention can be seen in the drawings. In particular, it is preferred to include markings or other indicia with respect to each hole particularly for designating tube location within the rack. It can be seen that each of the holes in the support member has a number 34 placed next to it in sequential fashion. In the embodiment being described, all of the 25 holes are so numbered. It can also be seen in the drawings that the corners 36 of the support member are rounded. It is preferred to include rounded corners on the support member of the present invention in order to minimize or eliminate sharp edges thereon which may penetrate the shipping bag or package into which the invention is placed after its fabrication and assembly, to thereby maintain sterility during shipment and storage.

While a variety of materials may be chosen to manufacture the support member of the present invention, the material of choice is one which may be thermoformed, such as plastic. One such thermoformable material which is desirable for the present invention is expandable polystyrene. It is further preferred that this polystyrene have a high density and be substantially free of debris. This type of material is substantially lightweight for the user, is readily fabricated into the desired shape and configuration, lends itself to providing holes therein for assuring a snug fit with the test tubes and is sufficiently inexpensive so that the support member is disposable after use.

Figure 4:
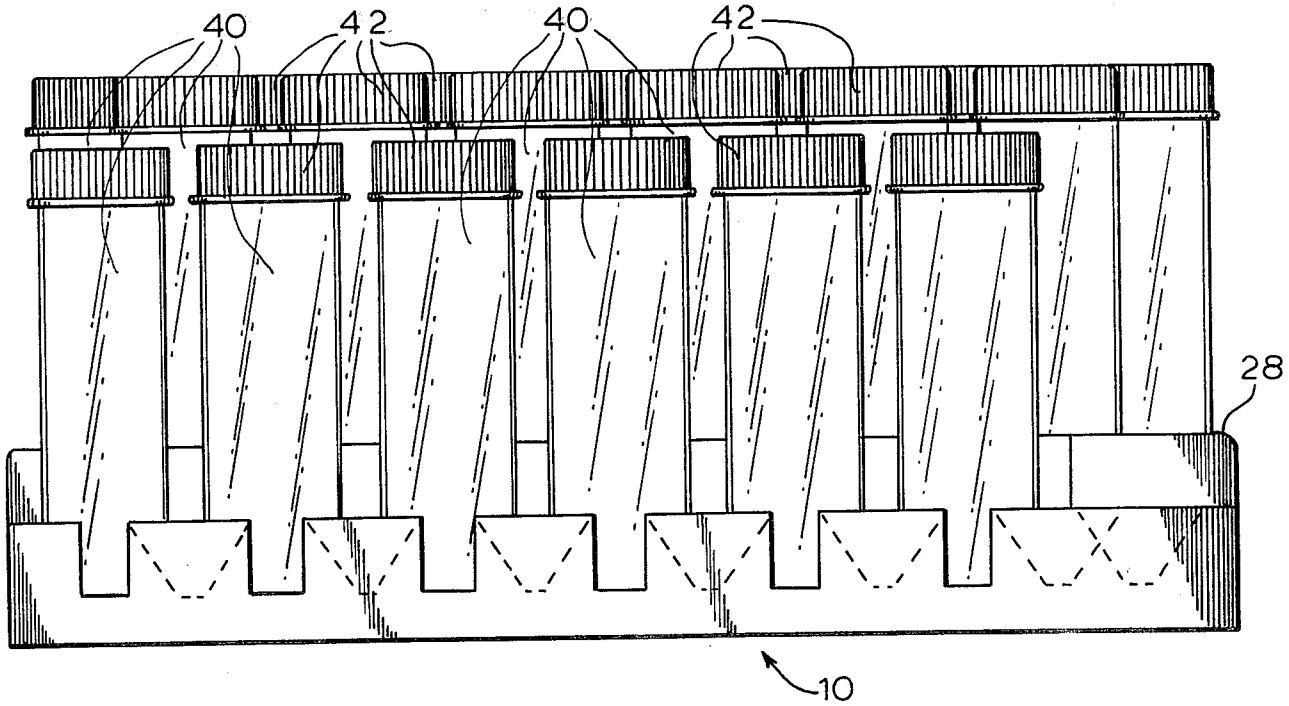
FIG. 4 is a side elevational view of the preferred multiple tube rack of the present invention illustrated assembled with test tubes.

Referring to FIGS. 4 and 5, rack 10 is illustrated with test tubes 40 positioned in each of holes 28. The staggered fashion of the test tubes becomes evident when viewing FIGS. 4 and 5. Furthermore, raised center portion 14 provides an incremental height advantage for those test tubes placed into the holes in the center portion. It can thus be seen that the upper ends of the tubes in the center portion are raised above the upper ends of the tubes positioned in the holes in the side portions of the support member. These upper ends of test tubes 40 are preferably enclosed by caps 42 removably positioned thereon. While the embodiment of FIGS. 4 and 5 illustrate a test tube in each of the holes in the support member, it is appreciated that the present invention may be pre-assembled with less than all of the holes being utilized. However, it is appreciated that the features of the present invention are intended to maximize the use of as many tubes as practicable in a limited space, while facilitating finger access to the individual tubes during use.

Thus, the present invention provides an improvement in tube holding racks particularly for holding a plurality of test tubes of the laboratory type.

What is claimed is:

1. A rack for holding a plurality of tubes comprising:

a substantially planar, relatively thick, one-piece support member made of thermoformed material having a center portion and a side portion along each side of the center portion, all of said portions extending substantially parallel to each other along the longitudinal axis of said support member, said center portion having an upper surface raised above the upper surfaces of said side portions and having a lower surface raised above the lower surfaces of said side portions;

a plurality of holes for receiving tubes therein in each of the aforementioned portions, said holes extending partially through said respective portions thereby forming closed bottoms thereof, said holes being tapered toward said bottom surfaces within the respective portions, all of said holes arranged in staggered fashion in said portions so that no adjacently lying holes are aligned on an axis substantially perpendicular to said longitudinal axis of said support member, all of said holes extending sufficiently deep into said respective portions to permit tubes positioned therein to stand upright without further support; and a slot adjacent each hole and communicating therewith, each of said slots extending partially through said respective portions to provide a view into the interior of its associated hole.

2. The rack of claim 1 wherein said center portion has a double row of staggered holes therein extending substantially parallel to said longitudinal axis.

3. The rack of claim 1 which further includes indicia associated with said holes for designation of tube location within said rack.

4. The rack of claim 1 wherein said material is expandable polystyrene.

5. The rack of claim 4 wherein said polystyrene has a high density and is substantially free of debris.

* * * * *